US007665924B2

(12) United States Patent
Hasegawa et al.

(10) Patent No.: US 7,665,924 B2
(45) Date of Patent: Feb. 23, 2010

(54) BACK PLATE AND FILE COVER FOR RING BINDER

(75) Inventors: Takao Hasegawa, Tokyo (JP); Masaru Ando, Tokyo (JP); Katsuya Nakamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 199 days.

(21) Appl. No.: 10/592,321

(22) PCT Filed: Mar. 15, 2005

(86) PCT No.: PCT/JP2005/005046

§ 371 (c)(1),
(2), (4) Date: Sep. 11, 2006

(87) PCT Pub. No.: WO2005/087508

PCT Pub. Date: Sep. 22, 2005

(65) Prior Publication Data

US 2007/0196162 A1 Aug. 23, 2007

(30) Foreign Application Priority Data

Mar. 16, 2004 (JP) ..... 2004-074853

(51) Int. Cl.
*B42F 13/02* (2006.01)

(52) U.S. Cl. ..... 402/21; 402/70; 402/58; 402/22; 281/19.2

(58) Field of Classification Search ..... 402/57, 402/70, 73, 74, 75, 76, 502, 80 R, 8, 18, 19, 402/26, 21, 22; 206/477, 478, 480, 481; 40/642.02, 649; D19/26, 27; 281/19.2, 27.1, 281/27.2, 27.3, 28, 36, 20–21
See application file for complete search history.

(56) References Cited

U.S. PATENT DOCUMENTS

| | | | | | |
|---|---|---|---|---|---|
| 491,473 | A | * | 2/1893 | Dom | 402/21 |
| 1,074,510 | A | * | 9/1913 | MacMaster | 402/70 |
| 1,466,313 | A | * | 8/1923 | Schade | 402/75 |
| 1,745,461 | A | * | 2/1930 | Trussell | 402/75 |
| 2,156,232 | A | * | 4/1939 | Trussell | 281/19.2 |
| 2,243,535 | A | * | 5/1941 | Newman | 402/37 |
| 2,262,601 | A | * | 11/1941 | Brook | 281/19.2 |
| 2,325,155 | A | * | 7/1943 | Wedge | 402/75 |
| 2,888,934 | A | * | 6/1959 | Segal | 402/37 |
| 3,252,461 | A | * | 5/1966 | Schade | 402/31 |
| 3,351,065 | A | * | 11/1967 | Roush | 402/70 |
| 4,120,517 | A | * | 10/1978 | Staats | 281/19.1 |

(Continued)

FOREIGN PATENT DOCUMENTS

DE 4126327 A1 * 2/1993

(Continued)

*Primary Examiner*—Dana Ross
*Assistant Examiner*—Jamila Williams
(74) *Attorney, Agent, or Firm*—Morgan, Lewis & Bockius LLP

(57) ABSTRACT

On the one surface of a back plate suited to a length-and-width size of a ring binder, hooks serving as an engaging means are formed. The back plate is fixed to the spine surface of the file cover. When the ring binder is pressed against the back plate, the hooks are engaged with the ring binder so that the file cover is mounted on a booklet bound with the ring binder.

6 Claims, 17 Drawing Sheets

U.S. PATENT DOCUMENTS

| | | | | | |
|---|---|---|---|---|---|
| 4,400,107 | A | * | 8/1983 | Pitts | 402/4 |
| 4,607,970 | A | | 8/1986 | Heusinkveld | |
| 4,750,884 | A | | 6/1988 | Bourgeois et al. | |
| 4,765,768 | A | * | 8/1988 | Wright | 402/30 |
| 4,941,804 | A | * | 7/1990 | Sarpy, Jr. | 412/7 |
| 5,037,229 | A | * | 8/1991 | Stengel | 402/20 |
| 5,348,412 | A | * | 9/1994 | Fuller | 402/75 |
| 5,975,576 | A | * | 11/1999 | Vogel | 281/16 |
| 5,988,926 | A | * | 11/1999 | Kiyomi | 402/70 |
| 6,010,270 | A | * | 1/2000 | Friedman | 402/21 |
| 6,692,029 | B2 | * | 2/2004 | Ke | 281/21.1 |
| 7,341,390 | B2 | * | 3/2008 | Chang | 402/60 |

FOREIGN PATENT DOCUMENTS

| | | | | |
|---|---|---|---|---|
| DE | 19602813 | A1 | * | 8/1996 |
| GB | 2224469 | A | * | 5/1990 |
| JP | U-48-27023 | | | 4/1973 |
| JP | 53-46215 | | | 4/1978 |
| JP | 61-138579 | | | 8/1986 |
| JP | 3049235 | | | 3/1988 |
| JP | 01-97979 | | | 6/1989 |
| JP | 06-29880 | | | 4/1994 |
| JP | 11-078338 | | | 3/1999 |
| JP | 11-151885 | | | 6/1999 |
| JP | 2000-289376 | | | 10/2000 |
| JP | 2001-18571 | | | 1/2001 |
| JP | 2003-320779 | | | 11/2003 |

* cited by examiner

BACK PLATE AND FILE COVER FOR RING BINDER

TECHNICAL FIELD

The invention relates to a filing tool, and more particularly to a back plate and a file cover detachable from a ring binder.

BACKGROUND ART

As a filing tool for binding documents punched by a multi-hole punching device or commercially available loose leaf sheets, there has been conventionally and widely used a filing binder in which metal or resin foldable ring binder is fixed to an inside of a spine surface of a file cover with a front surface, the spine surface and a rear surface.

Further, there are various shapes of single-body ring binders with no file covers. Among the single-body ring binders, there is a ring binder having comb-like resin strips in a planar shape which are bent cylindrically so that comb teeth are ring-shaped (for example, JP-A-2001-018571). If the cylindrical ring binder is expanded, a large number of comb teeth are inserted into punched holes of a sheet(s), respectively and thereafter expansion is cancelled, so that the ring binder is restored to the cylindrical shape, thereby binding the sheets.

Further, as ring binders permitting easier mounting, there is a resin ring binder in which ½ ring portions are arranged on both sides of a slender spine portion, and the ½ ring portions constituting pairs across the spine portion are closed in a ring shape so that their tips are fit to each other, thereby binding the sheets (JP-A-2000-289376), and a resin ring binder in which the ring portion is divided into three parts (e.g. JP-A-2003-320779).

The resin ring binder with no the file cover is light in weight and large in the sheet spreading angle so that it is a simple and convenient filing tool. However, since it is not accompanied by the spine surface, when the booklets bound with the ring binder are arranged or stacked on a bookshelf, the filing name of each booklet is difficult to know, and the entire booklet is likely to warp. For the reason, in order to bind the document with high importance or frequent use, the binder equipped with the file cover is employed. However, if a cover is required for the booklet once bound with the ring binder, work of removing the booklet from the ring binder and transferring it into the binder equipped with the cover must be executed. The work requires time and labor.

DISCLOSURE OF THE INVENTION

An object of the invention is to provide a back plate for ring binder which permits a file cover to be attached to or detached from a ring binder according to the use or purpose of a booklet, thereby improving convenience, and the file cover for the ring binder.

In order to attain the above object, an embodiment of the invention provides a back plate to be mounted on a ring binder having ring segments arranged on a spine segment, which is the back plate for a ring binder, comprising an engaging means for the ring binder, which is formed on the one surface of the back plate so that it is detachable from the ring binder.

Further, an embodiment of the invention provides a back plate for a ring binder, wherein the engaging means is flexible hooks, and the hooks are engaged with the spine segment or ring segments of the ring binder so that the ring binder and the back plate are coupled with each other.

An embodiment of the invention provides a back plate for a ring binder, wherein flexible bind tabs each protruding sideward from the side of the back plate is provided; hooks are formed at the tips of the bind tabs; engagement grooves are also formed in which the hooks are fit when the bind tabs are folded toward the back plate; and the bind tabs are folded to be hung over the spine segment of the ring binder so that the hooks are fit in the engagement grooves, thereby coupling the ring binder and back plate with each other.

Further, an embodiment of the invention provides a file cover for a ring binder, wherein the back plate is mounted on the spine surface of the file cover serving as the surface of a booklet so that the file cover is detachable from the ring binder.

Figure 1A:
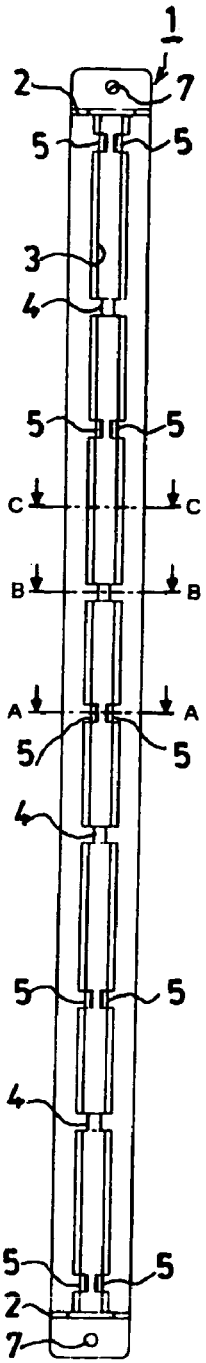
FIG. 1A is a front view of a back plate according to a first embodiment of the invention.

In the drawings, reference numeral 1 denotes a back plate; 2 a positioning convex portion; 3 a ring-receiving portion; 4 a spine-receiving portion; 5 a hook; 6 a file cover; 8 a ring binder; 8*a* a spine segment; 8*b* a ring segment, 11 a back plate; 12 a hook; 13 a ring-receiving portion; 21 a back plate; 22 a bind tab; 23 a hook; 24 a groove hole, 25 a groove; 26 a ring-receiving portion; 31 a back plate; 32 a T groove; and 33 a file name plate.

BEST MODE FOR CARRYING OUT THE INVENTION

Embodiments of the invention will be described with reference to the accompanying drawings.

First Embodiment

Figure 1B:
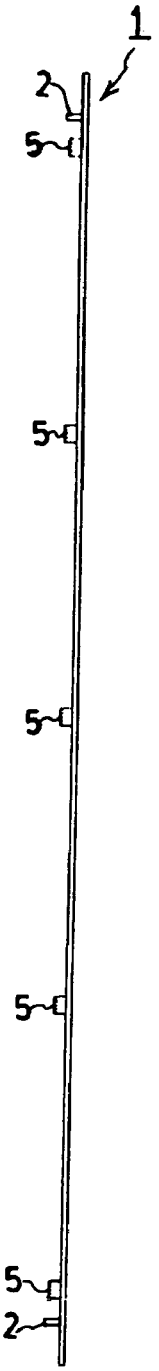
FIG. 1B is a right side view of the back plate according to the first embodiment.
Figure 1C:
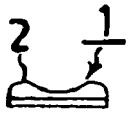
FIG. 1C is a lower side view of the back plate according to the first embodiment.
Figure 2A:
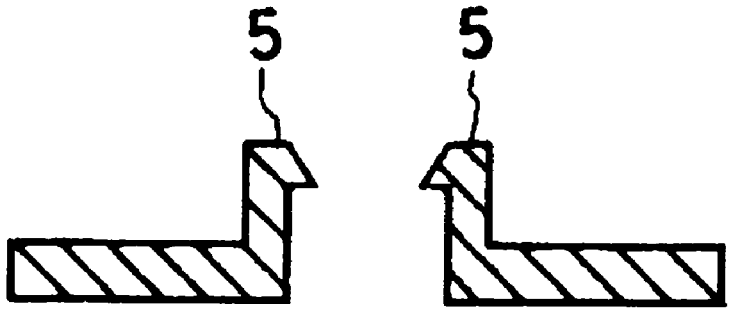
FIG. 2A is a sectional view taken in arrow line A-A in FIG. 1A.
Figure 2B:
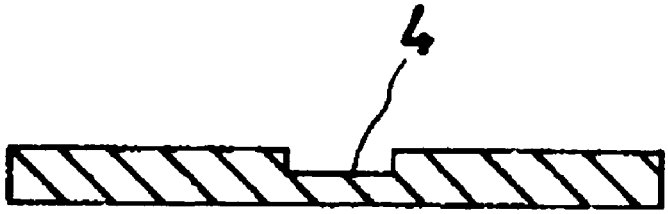
FIG. 2B is a sectional view taken in arrow line B-B in FIG. 1A.
Figure 2C:
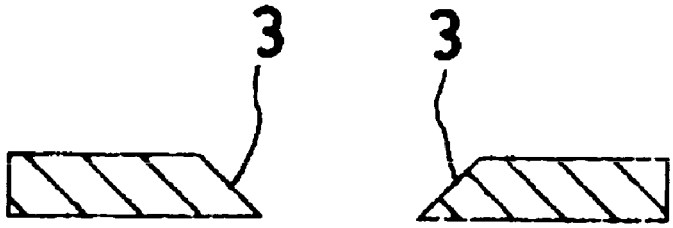
FIG. 2C is a sectional view taken in arrow line C-C in FIG. 1A.

FIGS. 1A to 1C show a back plate 1 mountable in a ring binder. A V-shaped ring receiving portion 3 is formed between convexes 2 made in the vicinity of the upper and lower ends on the front. In the ring receiving portion 3, concave-groove spine receiving segments 4 for receiving the spine of the ring binder and hooks 5 to be engaged with the spine of the ring binder are formed at regular intervals. FIGS. 2A, 2B and 2C show sections taken in lines A-A, B-B and C-C in FIG. 1A, respectively. The hooks 5 are oppositely arranged left and right across a laterally center line of the back plate 1. The hooks 5 are engaged onto the upper face of the spine of the ring binder inserted between the opposite hooks 5, thereby holding the spine.

Figure 3A:
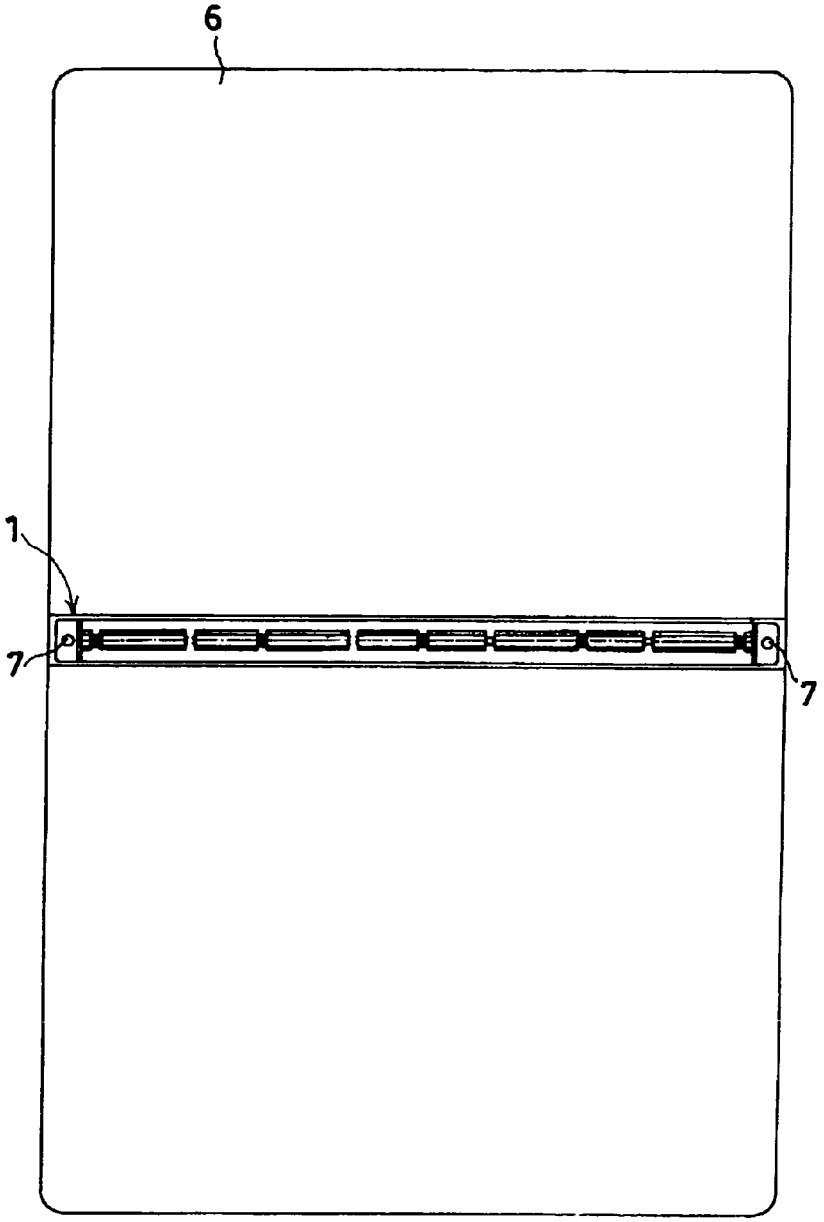
FIG. 3A is a front view of the state where the back plate according to the first embodiment is attached to a file cover.
Figure 3B:
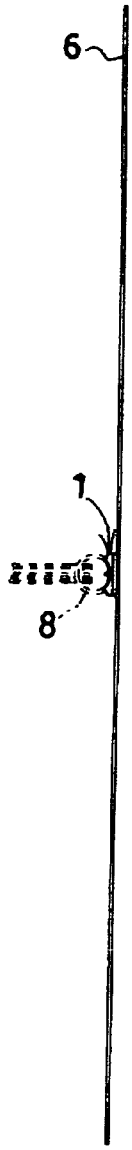
FIG. 3B is a side view of the state where the back plate according to the first embodiment is attached to a file cover.

FIGS. 3A and 3B show the state where the back plate 1 is mounted inside the spine surface of a file cover 6 made of resin or thick paper. The back plate 1 may be coupled with the file cover 6 by means of grommetting or riveting using circular holes 7 formed in the vicinity of both upper and lower ends, or otherwise may be coupled with the file cover 6 by means of bonding or welding. The coupling means should not be particularly limited.

Figure 4:
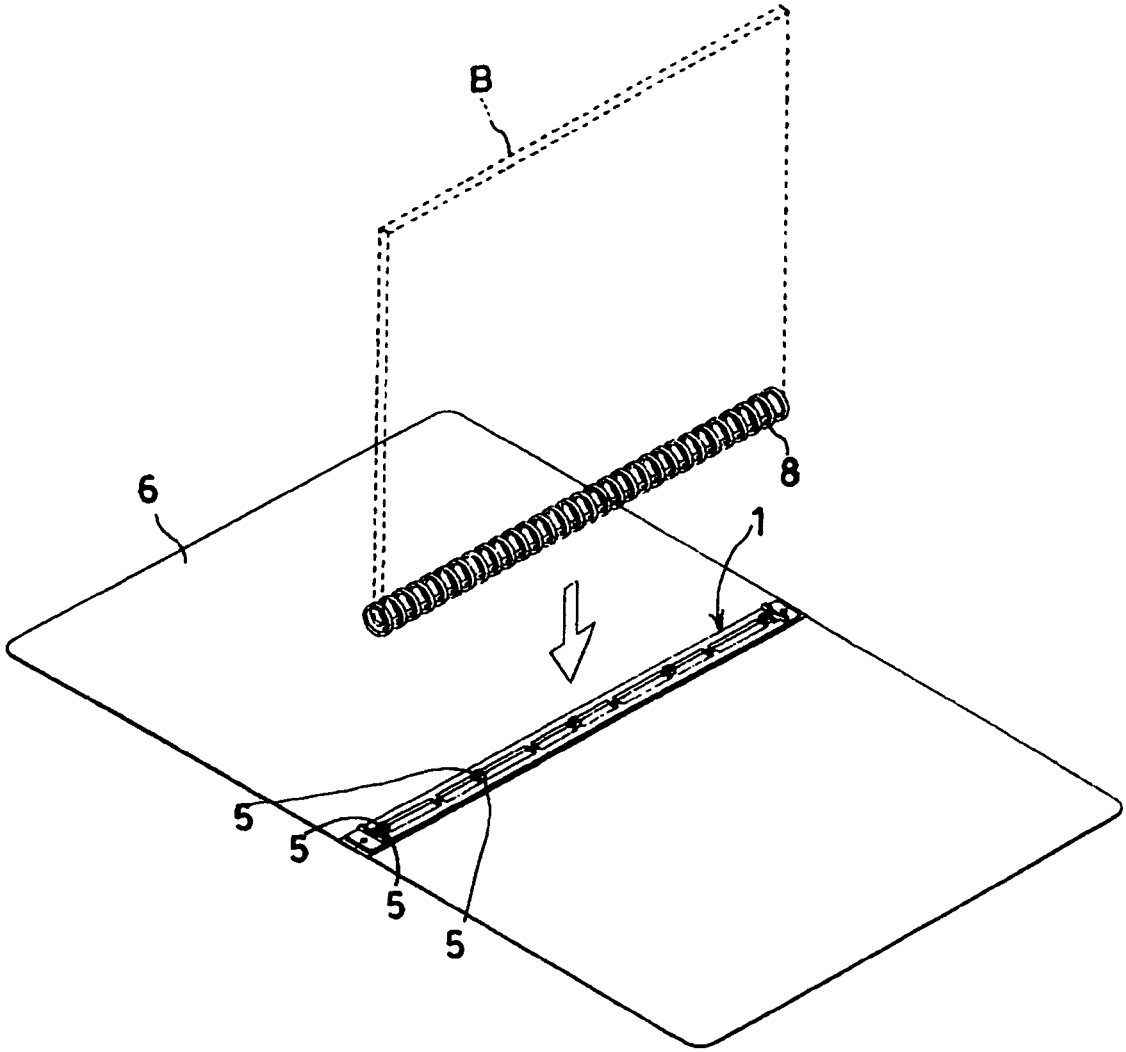
FIG. 4 is a view for explaining the procedure of attaching the ring binder to the back plate according to the first embodiment.
Figure 5A:
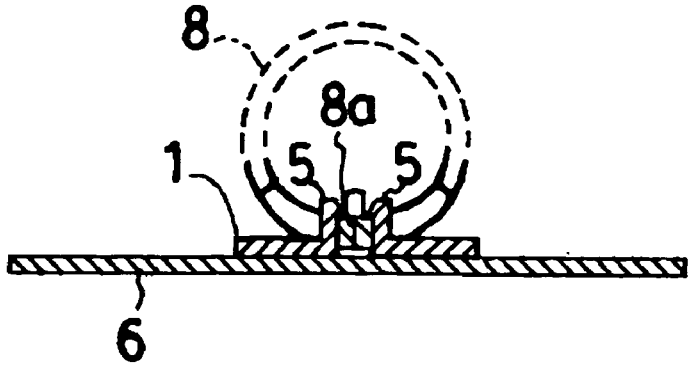
FIG. 5A is a sectional view taken in arrow line A-A in FIG. 1A showing the state where the back plate according to the first embodiment is attached to a file cover.
Figure 5B:
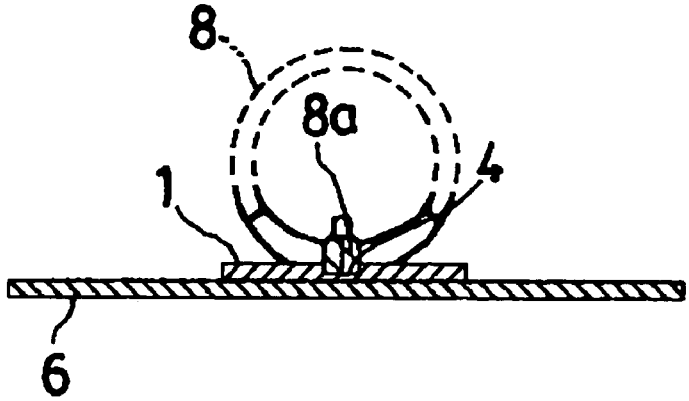
FIG. 5B is a sectional view taken in arrow line B-B in FIG. 1A showing the state where the back plate according to the first embodiment is attached to a file cover.
Figure 5C:
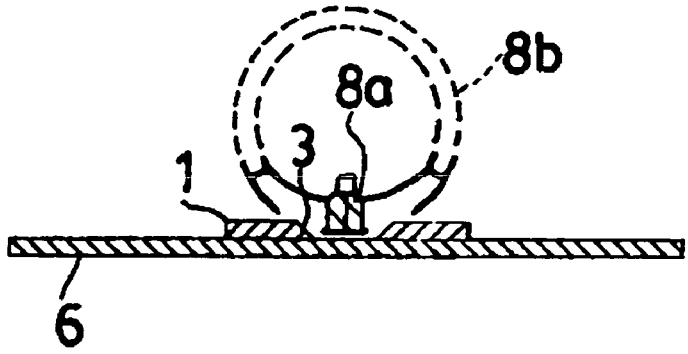
FIG. 5C is a sectional view taken in arrow line C-C in FIG. 1A showing the state where the back plate according to the first embodiment is attached to a file cover.

FIG. 4 shows the procedure for coupling the ring binder 8 and the back plate 1. With a booklet B bound with the ring binder 8 being held by a hand, the spine segment of the ring binder 8 is pressed against the back plate 1 so as to be opposed to the ring receiving portion 3 of the back plate 1. The hooks 5 of the back plate 1 are forcibly expanded by the spine segment of the ring binder 8. Thus, as shown in FIG. 5A, the hooks 5 sandwiches the spine segment 8*a* from both left and right sides so that the ring binder 8 and the back plate 1 are coupled with each other. FIGS. 5A, 5B and 5C are sectional views corresponding to FIGS. 2A, 2B and 2C. As shown in FIG. 5B, the spine segment 8*a* of the ring binder 8 is engaged in and supported by the concave-groove of the spine receiving segment 4. As shown in FIG. 5C, the ring segments 8*b* of the ring binder 8 are placed on and supported by the ring receiving portion 3.

Figure 6:
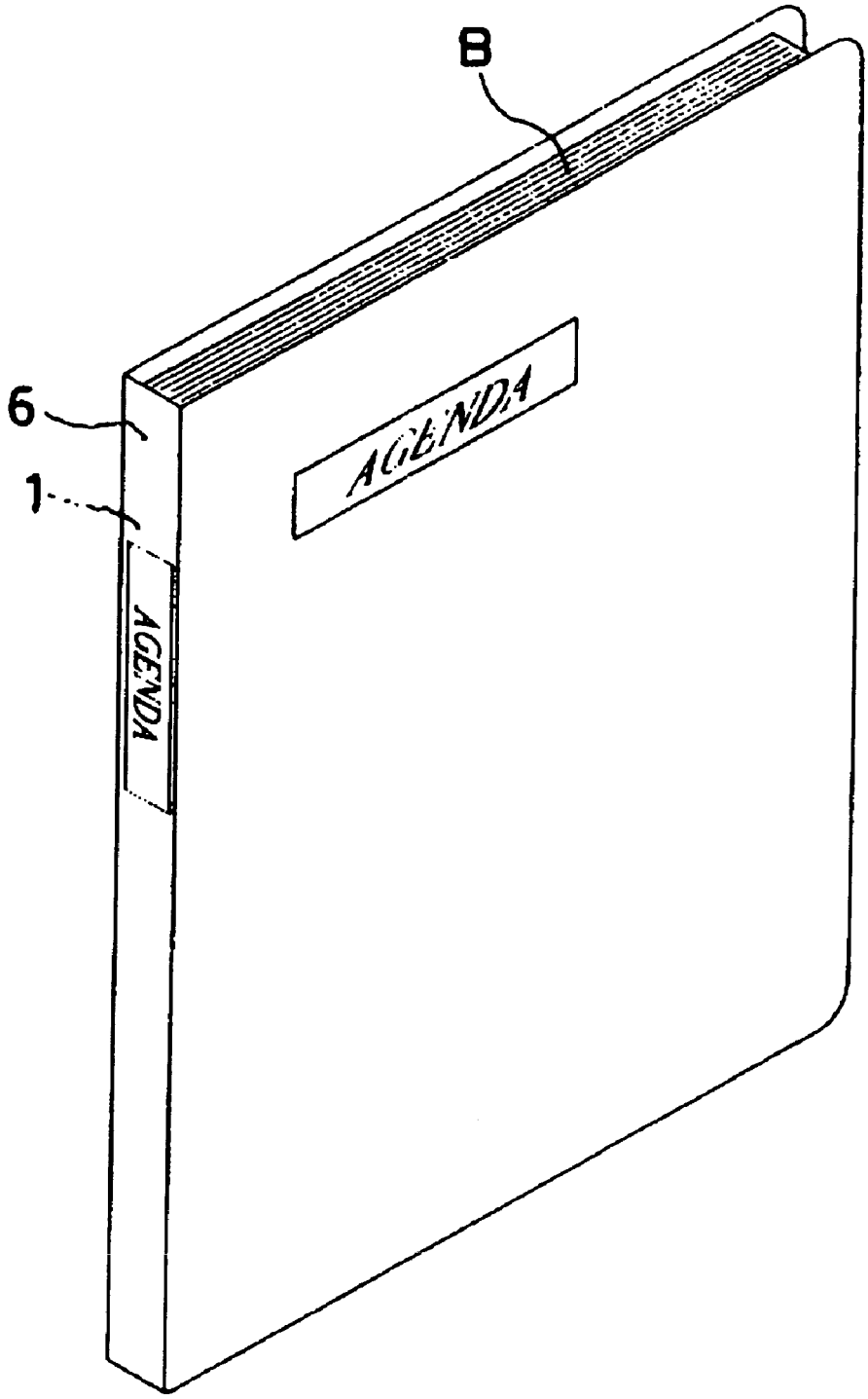
FIG. 6 is a view showing the state where a ring binder and a booklet are attached to the back plate equipped with the file cover.

FIG. 6 shows the state where the file cover 6 is mounted on the booklet B bound with the ring binder 8 through the back plate 1. It is needless to say that on the spine surface or front surface of the file cover 6, a file name and other matters can be indicated or a seal can be affixed. Thus, from the indication on the spine surface, the file name of the booklet can be known when the booklet is housed or stacked on a bookshelf.

Second Embodiment

Figure 7A:
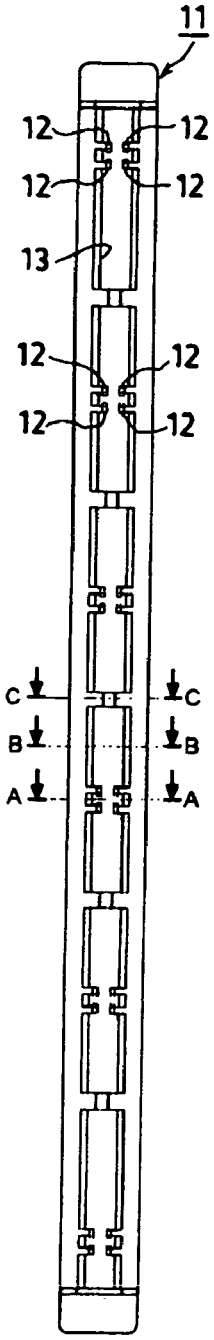
FIG. 7A is a front view of a back plate according to a second embodiment.
Figure 7B:
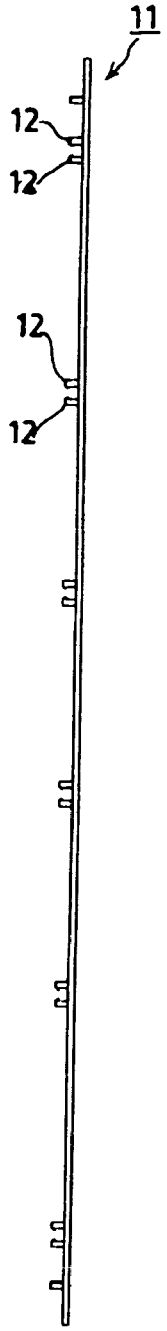
FIG. 7B is a right side view of the back plate according to the second embodiment.
Figure 7C:
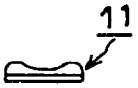
FIG. 7C is a lower side view of the back plate according to the second embodiment.
Figure 8A:
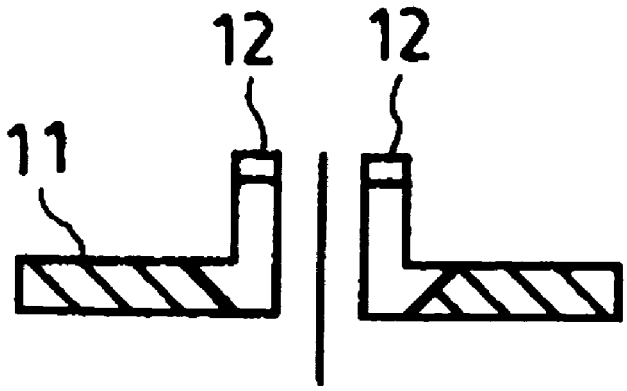
FIG. 8A is a sectional view taken in arrow line A-A in FIG. 7A.
Figure 8B:
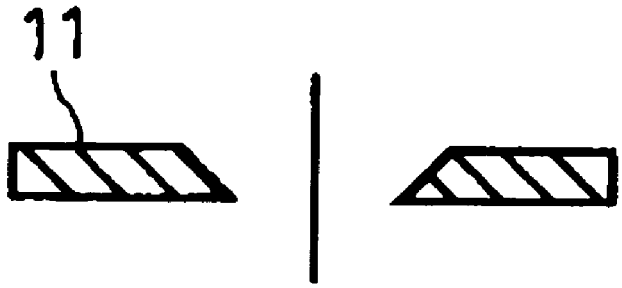
FIG. 8B is a sectional view taken in arrow line B-B in FIG. 7A.
Figure 8C:
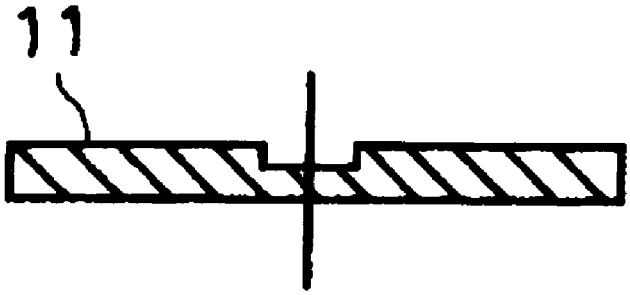
FIG. 8C is a sectional view taken in arrow line C-C in FIG. 7A.
Figure 9:
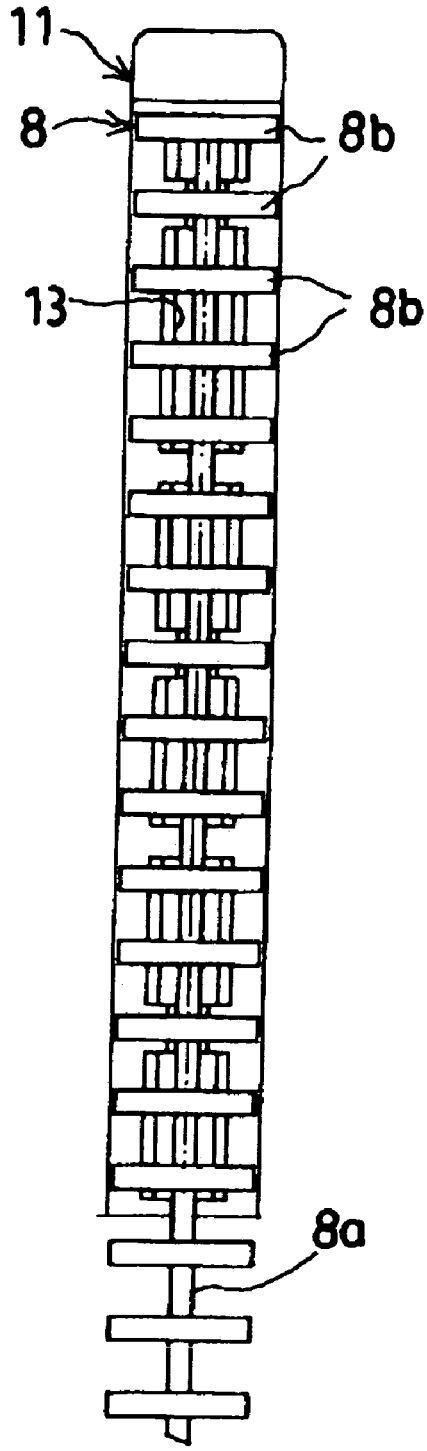
FIG. 9 is a plan view of the state where a ring binder is coupled with the back plate according to the second embodiment.
Figure 10A:
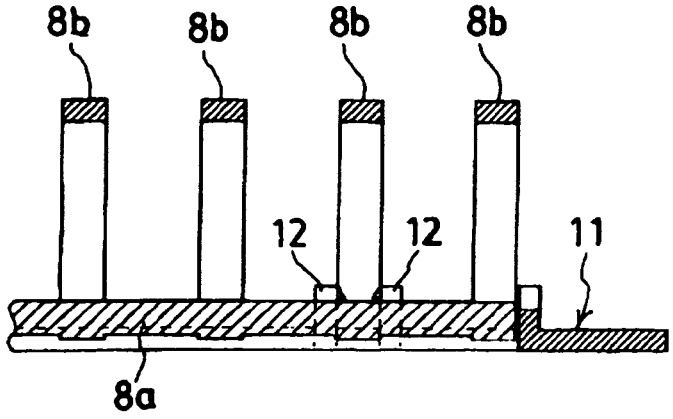
FIG. 10A is a side sectional view of the state where a ring binder is coupled with the back plate according to the second embodiment.
Figure 10B:
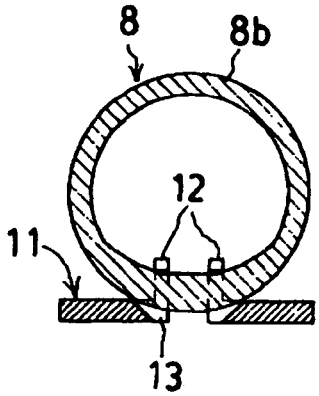
FIG. 10B is a front sectional view of the state where a ring binder is coupled with the back plate according to the second embodiment.

FIGS. 7A to 7C show a back plate 11 according to a second embodiment. In the back plate 11 according to the second embodiment, the direction of hooks is different from that in the back plate 1 according to the first embodiment. The tips of hooks 12 vertically making pairs are opposite to each other. FIGS. 8A, 8B and 8C shows section taken in lines A-A, B-B and C-C in FIG. 7A, respectively. FIGS. 9, 10A and 10B show the state where the ring binder 8 is coupled with the back plate 11. If the spine segments of the ring binder 8 are pressed against the back plate 11 so as to be opposite to the ring receiving portion 13 of the back plate 11, the hooks 12 of the back plate 11 are forcibly expanded by the ring segments 8*b* of the ring binder 8. Thus, as shown in FIGS. 10A and 10B, the ring segments 8*b* each is sandwiched and engaged vertically from both sides by the hooks 12 so that the ring binder 8 and the back plate 11 are coupled with each other.

Third Embodiment

Figure 11:
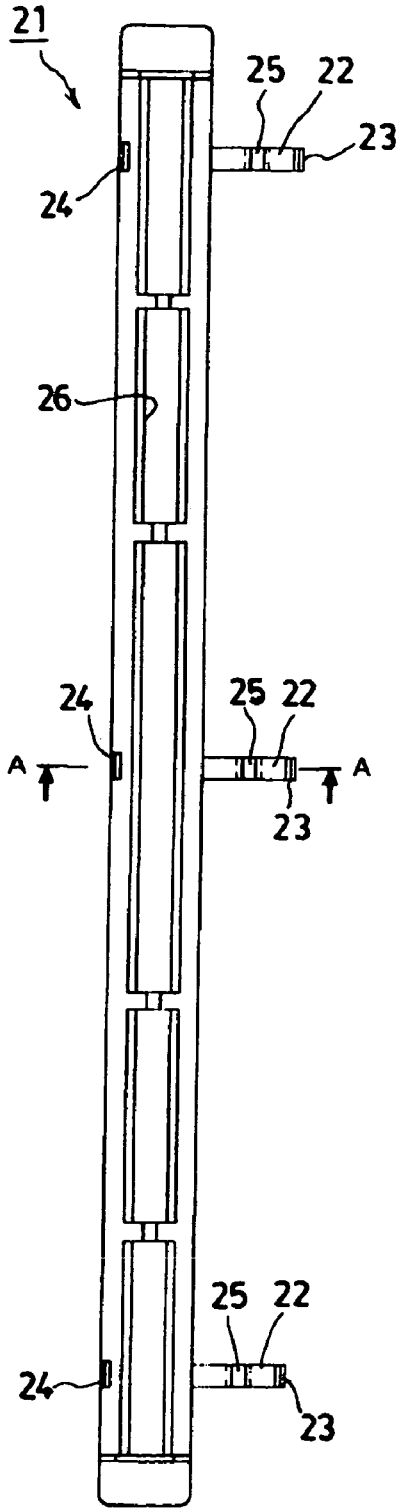
FIG. 11 is a front view of the back plate according to the third embodiment.
Figure 12A:
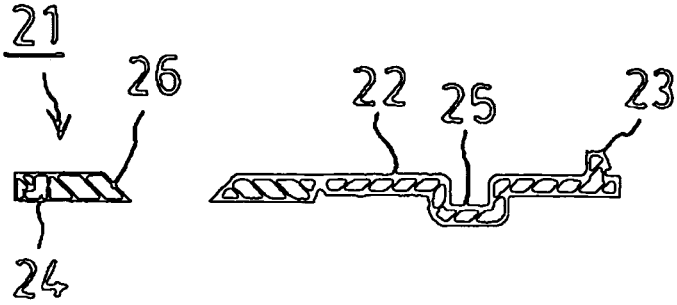
FIG. 12A is a sectional view taken arrow line A-A in FIG. 11, showing a bind tab before bent.

A back plate 21 shown in FIG. 11 is provided with bind tabs 22 in place of the hooks as the coupling means for the ring binder. The bind tabs 22 laterally protrude from an upper position, vertically intermediate position and lower position of the one side of the back plate 21. At the tips of the bind tabs 22, hooks 23 are formed, respectively. At the edges of the back plate 21 on a side opposite to the side where the bind tabs are attached, groove holes 24 each constituting a fitting pair with the hook 23 of the bind tab 22 are formed. FIGS. 12A shows a section taken in line A-A in FIG. 11.

Figure 12B:
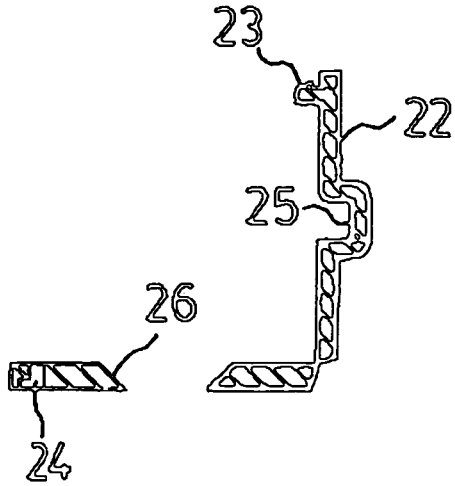
FIG. 12B is a sectional view taken arrow line A-A in FIG. 11, showing the bind tab after bent by 90°.
Figure 12C:
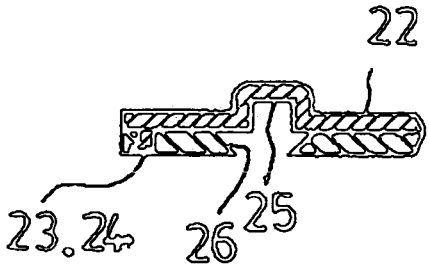
FIG. 12C is a sectional view taken arrow line A-A in FIG. 11, showing the bind tab after bent by 180°.

At the laterally intermediate positions of the bind tabs 22, grooves 25 in which the spine segment of the ring binder 8 is fit are formed. As shown in FIGS. 12A and 12B, if the bind tabs 22 are bent by 180° so that the hooks 23 of the bind tabs 22 are inserted into the groove holes 24, the hooks 23 are engaged in the groove holes 24. Thus, the bind tabs 22 are fixed in a folded state.

Figure 13:
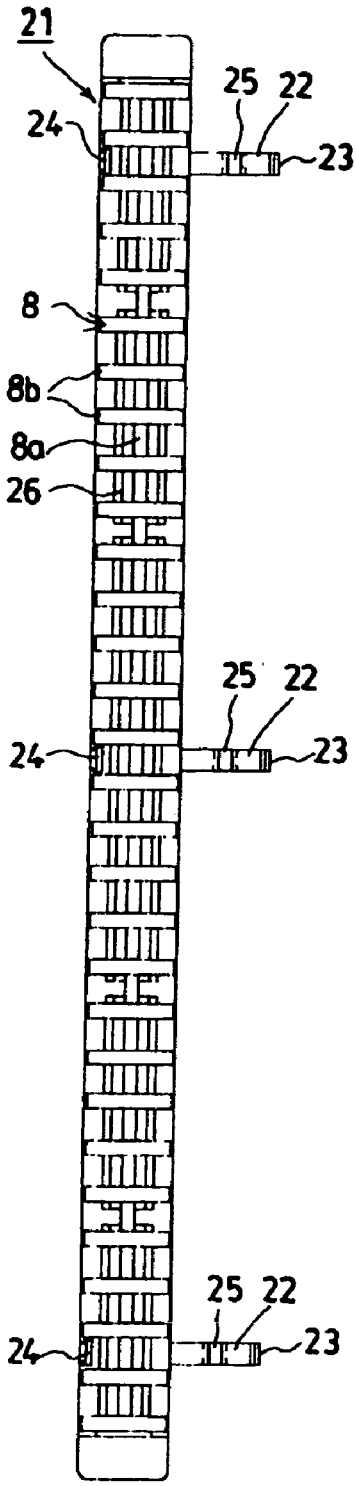
FIG. 13 is a plan view of the state where a ring binder is placed on the back plate according to a third embodiment.

FIG. 13 shows the state where the ring binder 8 is placed on the back plate 21. As shown in FIG. 13, each bind tab 22 is arranged so that it is located between the ring segments 8*b* of the ring binder 8.

Figure 14A:
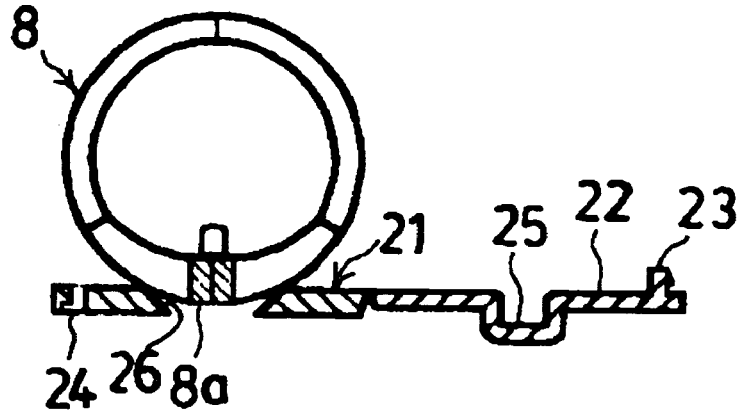
FIG. 14A is a view for explaining the procedure of attaching a ring binder to the back plate according to the third embodiment, which shows the status before the bind tab is bent.
Figure 14B:
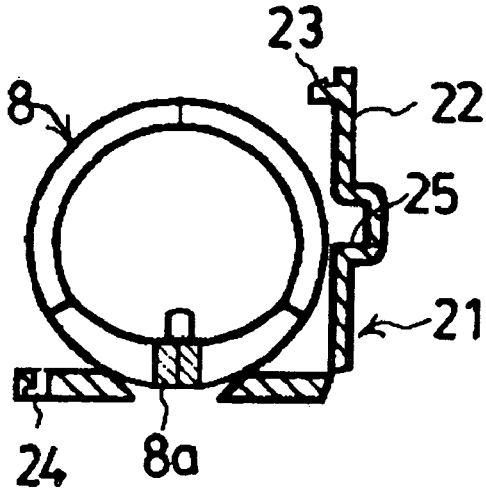
FIG. 14B is a view for explaining the procedure of attaching the ring binder to the back plate according to the third embodiment, which shows the status after the bind tab has been bent by 90°.
Figure 14C:
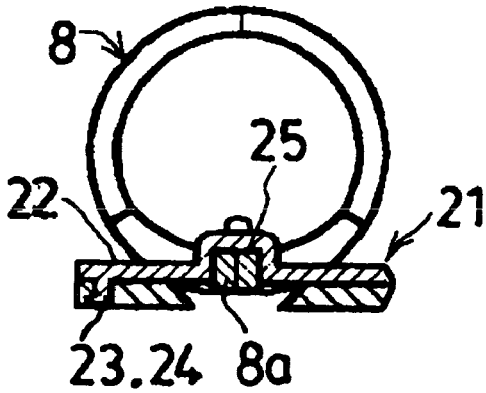
FIG. 14C is a view for explaining the procedure of attaching the ring binder to the back plate according to the third embodiment, which shows the status after the bind tab has been bent by 180°.

FIGS. 14A to 14C show the procedure of coupling the ring binder 8 and the back plate 21 with each other. As shown in FIG. 14A, the spine segment 8*a* of the ring binder 8 is oppositely placed on the ring receiving portion of the back plate 21. As shown in FIG. 14B, the bind tabs 22 are bent toward the back plate. Further, as shown in FIG. 14C, if the hooks 23 of the bind tabs 22 are inserted into the groove holes 24, respectively, the spine segment 8*b* of the ring binder 8 is fit in the grooves 25 of the bind tubs 22. In addition, the hooks 23 of the bind tabs 22 are engaged in the groove holes 24 of the back plate 21. Thus, the ring binder 8 is fixed in the state where the bind tabs 21 are fixed in the folded state.

Figure 15:
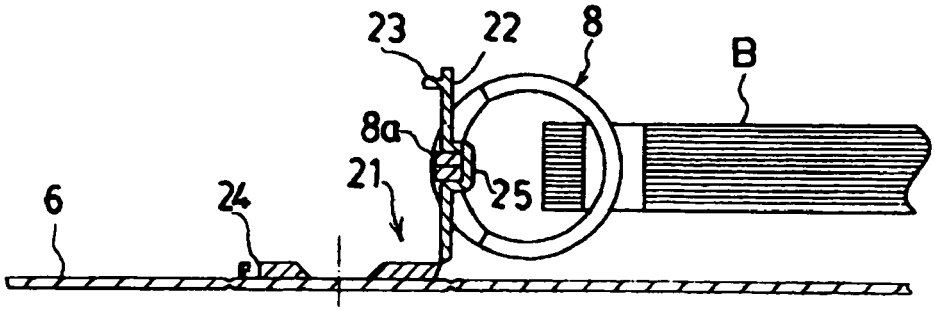
FIG. 15 is a view for explaining the procedure of attaching the back plate according to the third embodiment to a booklet bound with the ring binder.

Incidentally, the booklet previously bound with the ring binder can be attached to the back plate 21 in such a manner that as shown in FIG. 15, the booklet B pushed over sideways by causing the bind tabs 22 to stand up is moved down from above so that the bind tabs 22 pass through the gap between the spine segment 8*a* of the ring binder 8 and the back of the booklet B.

Fourth Embodiment

In the first to third embodiments, the back plates are used in a state attached to the file cover. However, the back plate may be used as a single body. In the case, by making the spine (surface) of the back plate in a flat shape with no opening, affixing a seal filled with a file name on the spine surface, directly entering the file name, the retrieval of the booklet is facilitated.

Figure 16:
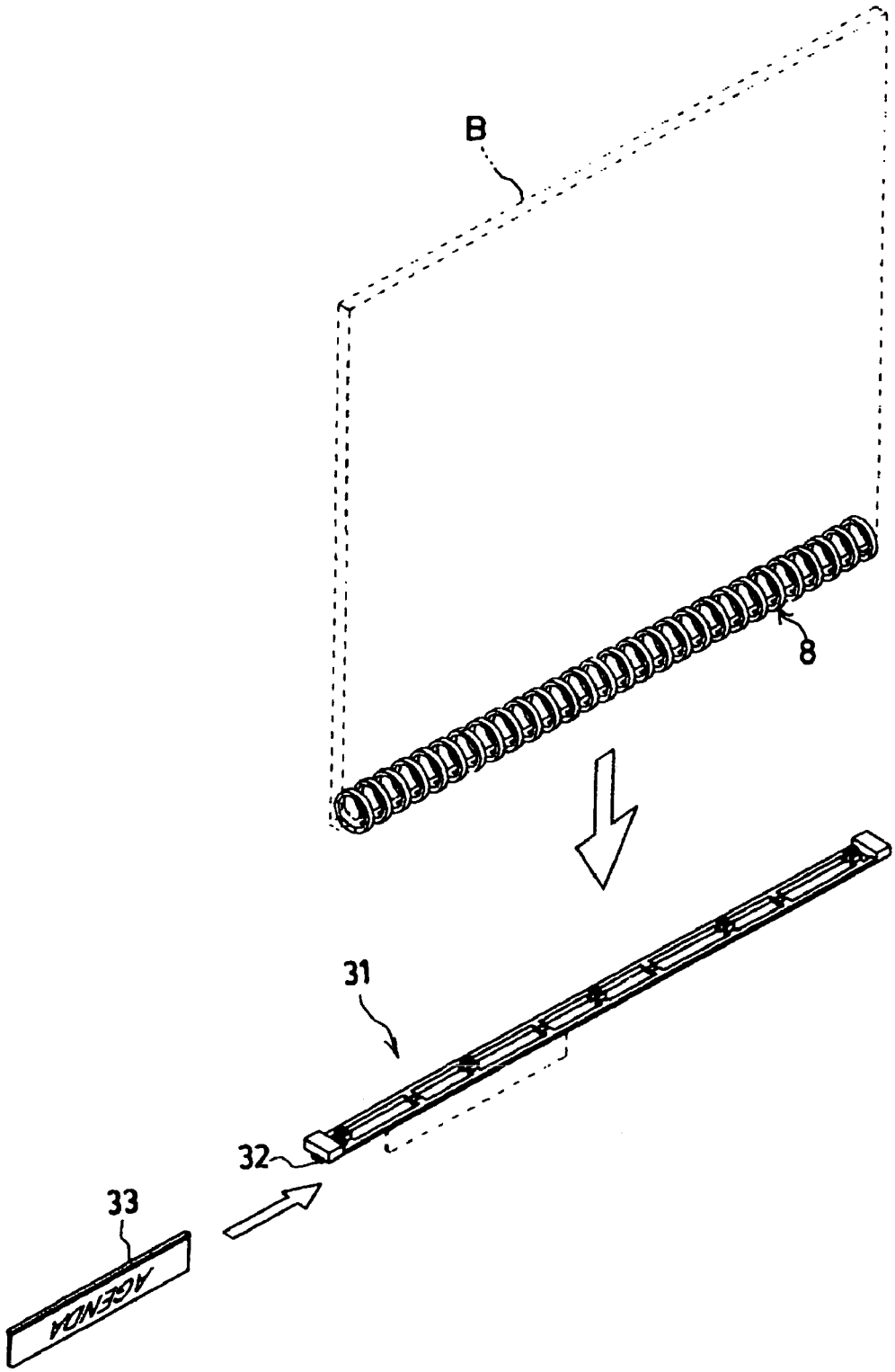
FIG. 16 is a view for explaining the procedure of attaching the ring binder to the back plate according to a fourth embodiment.
Figure 17:
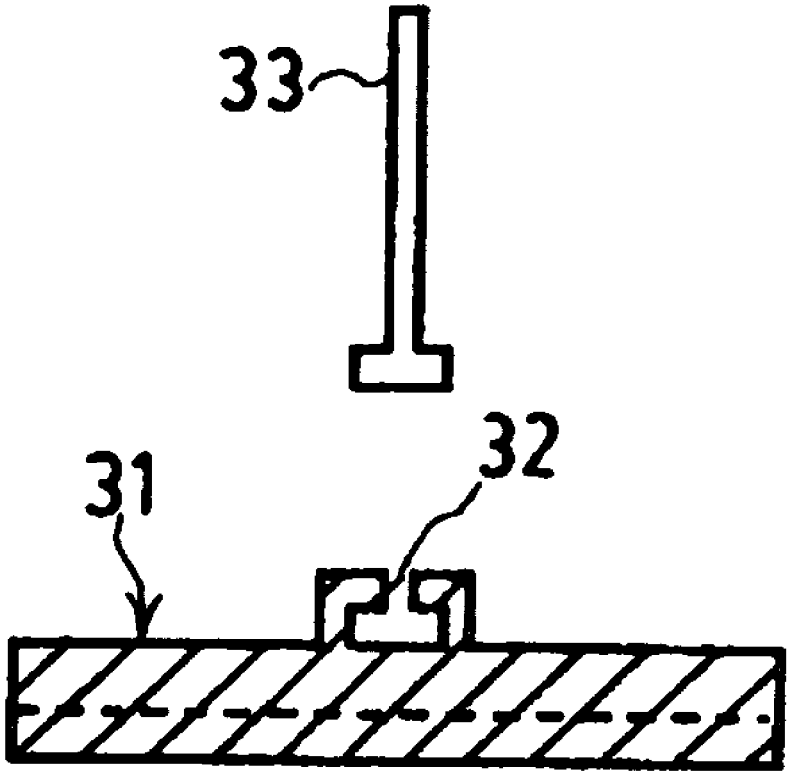
FIG. 17 is a sectional view of the back plate and a file name plate according to the fourth embodiment.

Further, as shown in FIGS. 16 and 17, a T-shape groove 32 may be formed on the spine of the back plate 31 and a file name plate 33 having a T-shape section and filled with a file name may be engaged in the T-shape groove 32. Such a back plate is preferably used when the booklet B is housed vertically in a file case with the spine of the booklet B being oriented upward.

It will be apparent that the invention should not be limited to the embodiments described above, but may be modified in various manners within a technical scope of the invention and covers these modifications.

The application is based on Japanese Patent Application No. 2004-074853 filed on Mar. 16, 2004, and contents of which are incorporated herein by reference.

INDUSTRIAL APPLICABILITY

In the embodiments of the invention, since the back plate serving as the spine of the booklet is formed detachably from the ring binder, by attaching the back plate to the ring binder binding the booklet and entering e.g. a file name on the back plate, the retrieval of the booklet is facilitated. The back plate has an effect of restraining the warp of the booklet and ring binder. Further, by firmly integrating the back plate to the spine surface of the file cover, the file cover can be attached to or detached from the booklet as required.

In the embodiments of the invention, since the back plate serving as the spine of the booklet is provided with the engagement means such as hooks, the back plate is made detachable from the ring binder. The back plate may be mounted in the ring binder as a single body. Further, by fixing the back plate inside the spine surface of the file cover, the file cover can be easily mounted on the booklet bound with the ring binder.

The invention claimed is:

1. A back plate for a ring binder, to which a ring binder including a spine segment and a ring segment is detachably mounted, comprising:

an engaging means formed on one surface of the back plate to be engaged with the ring binder, wherein the engaging means comprises:

a bind tab protruding sideward from a side of the back plate;

a hook formed at a tip of the bind tab; and an engagement groove to which the hook is engaged when the bind tab is folded toward the back plate, and wherein the bind tab is folded to be hung over the spine segment of the ring binder, and the hook is fit in the engagement groove so that the ring binder and the back plate are coupled with each other, and the engagement groove is disposed on a side of the back plate opposite the side from which the bind tab protrudes.

2. The back plate for a ring binder according to claim 1, wherein the spine segment of the ring binder is disposed between the engagement groove and the side of the back plate from which the bind tab protrudes when the ring binder and the back plate are coupled with each other.

3. A file cover for a ring binder, comprising:

a spine surface, and a back plate for a ring binder, to which a ring binder including a spine segment and a ring segment is detachably mounted, the back plate comprising:

an engaging means formed on one surface of the back plate to be engaged with the ring binder, wherein the engaging means comprises:

a bind tab protruding sideward from a side of the back plate;

a hook formed at a tip of the bind tab; and an engagement groove to which the hook is engaged when the bind tab is folded toward the back plate, and wherein the bind tab is folded to be hung over the spine segment of the ring binder, and the hook is fit in the engagement groove so that the ring binder and the back plate are coupled with each other, and the engagement groove is disposed on a side of the back plate opposite the side from which the bind tab protrudes, wherein the back plate is mounted on the spine surface.

4. The file cover for a ring binder according to claim 3, wherein the spine segment of the ring binder is disposed between the engagement groove and the side of the back plate from which the bind tab protrudes when the ring binder and the back plate are coupled with each other.

5. A back plate for a ring binder, to which a ring binder including a spine segment and a ring segment is detachably mounted, comprising:

a bind tab protruding sideward from a side of the back plate;

a hook formed at a tip of the bind tab;

an engagement groove to which the hook is engaged when the bind tab is folded toward the back plate; and a spine segment receiving portion to which the spine segment of the ringer binder is engaged when the ring binder and the back plate are coupled with each other, and wherein the bind tab is folded to be hung over the spine segment of the ring binder, and the hook is fit in the engagement groove so that the ring binder and the back plate are coupled with each other, and the engagement groove is disposed on a side of the back plate opposite the side from which the bind tab protrudes.

6. The back plate for a ring binder according to claim 5, wherein the spine segment of the ring binder is disposed between the engagement groove and the side of the back plate from which the bind tab protrudes when the ring binder and the back plate are coupled with each other.

* * * * *